US009372462B1

(12) United States Patent
Ohta

(10) Patent No.: US 9,372,462 B1
(45) Date of Patent: Jun. 21, 2016

(54) IMAGE FORMING APPARATUS

(71) Applicant: CANON KABUSHIKI KAISHA, Tokyo (JP)

(72) Inventor: Tetsuya Ohta, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/976,313

(22) Filed: Dec. 21, 2015

(30) Foreign Application Priority Data

Jan. 9, 2015 (JP) ..... 2015-002971

(51) Int. Cl.
*G03G 15/16* (2006.01)
*G03G 15/00* (2006.01)

(52) U.S. Cl.
CPC ..... *G03G 15/50* (2013.01); *G03G 15/16* (2013.01); *G03G 15/161* (2013.01); *G03G 15/1675* (2013.01)

(58) Field of Classification Search
CPC ..... G03G 15/50; G03G 15/16; G03G 15/161; G03G 15/1675
USPC ..... 399/66, 101
See application file for complete search history.

(56) References Cited

U.S. PATENT DOCUMENTS

| | | | | |
|---|---|---|---|---|
| 6,434,344 | B1 | 8/2002 | Yoshida et al. | |
| 8,095,032 | B2 | 1/2012 | Torimaru et al. | |
| 8,290,385 | B2 * | 10/2012 | Nakagawa | G03G 21/0047 399/101 |
| 2014/0023388 | A1 * | 1/2014 | Yoshida | G03G 15/14 399/66 |

FOREIGN PATENT DOCUMENTS

| | | | |
|---|---|---|---|
| JP | 2000155483 | A | 6/2000 |
| JP | 2002258714 | A | 9/2002 |
| JP | 2009180868 | A | 8/2009 |
| JP | 2012063535 | A | 3/2012 |
| JP | 2013235292 | A | 11/2013 |

OTHER PUBLICATIONS

U.S. Appl. No. 14/996,292, Tetsuya Ohta, filed Jan. 15, 2016.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a movable image bearing member, a transfer member, a constant voltage source for applying a transfer voltage and a returning voltage to the transfer member, an executing portion capable of selectively executing an operation in a first mode in which image formation is executed at a first speed and an operation in a second mode in which the image formation is effected at a speed slower than the first speed, and a setting portion for setting a falling time from transfer voltage falling start timing toward the returning voltage until a current flowing through said transfer member is zero. The setting portion sets the falling time in the operation in the second mode so as to be longer than the falling time in the operation in the first mode.

6 Claims, 13 Drawing Sheets

IMAGE FORMING APPARATUS

FIELD OF THE INVENTION AND RELATED ART

The present invention relates to an image forming apparatus, of an electrophotographic type, such as a laser printer, a copying machine or a facsimile machine.

As a multi-color or full-color image forming apparatus of the electrophotographic type, an image forming apparatus of an intermediary transfer type has been put into practical use. In the intermediary transfer type, toner images of respective colors formed on photosensitive drums are superposed by being successively primary-transferred onto an intermediary transfer belt. Then, a plurality of toner images superposed and carried on the intermediary transfer belt are collectively secondary-transferred onto a recording material by applying a voltage to a secondary transfer roller.

At a non-image portion of the intermediary transfer belt, even at a white-background portion where the toner image is not carried, a fog toner in a small amount deposits. For that reason, when image formation is continued, the fog toner is transferred onto the secondary transfer roller and electric charges become lost, so that the fog toner gradually accumulates. Then, the toner accumulated on the secondary transfer roller is scraped off by a back surface of the recording material on which the image formation is effected. For that reason, when an amount of the toner accumulated on the secondary transfer roller exceeds a predetermined limit amount, back surface (side) contamination of the recording material with the toner becomes conspicuous.

Japanese Laid-Open Patent Application (JP-A) 2009-180868 has proposed such a technique that a cleaning device exclusively for a secondary transfer roller is provided and thus accumulation of a toner on the secondary transfer roller is prevented. JP-A 2013-235292 has proposed control in which accumulation of a toner on a secondary transfer roller is suppressed to a minimum by applying a voltage, to the secondary transfer roller, of the same polarity as a charge polarity of a fog toner deposited on a non-image portion of an intermediary transfer belt.

Most of the above-described fog toner has the same polarity as the charge polarity of the toner during image formation. For that reason, an applied to the secondary transfer roller is caused to have an opposite polarity to the charge polarity of the toner during the image formation and is caused to have the same polarity as the charge polarity of the toner during a recording material feeding interval, so that it is possible to suppress the accumulation of the toner on the secondary transfer roller.

In the image forming apparatus, in order to meet diversification of users in recent years, a speed (process speed) in a transfer step and a fixing step is changed depending on a species of the recording material. Conventionally, when thick paper, coated paper, an OHT sheet or the like is used as a final recording material, for example, an image forming apparatus in which the process speed in the transfer step and the fixing step is lowered to about half of the process speed when pain paper is used has been known. Hereinafter, an operation in a mode in which printing is made at a normal process speed is referred to as an operation in a constant speed mode. An operation in a mode in which the printing is made at a step which is lowered from the normal process speed to about half of the normal process speed is referred to as an operation in a half speed mode.

In the case where the toner image is transferred onto the thick paper or the like, there is a problem such that an electric field becomes small compared with the case of the plain paper and thus improper transfer generates. In addition, in the case where the toner image is fixed on the thick paper or the like, there is a problem such that a manner of heat conduction is weaker than that in the case of the plain paper and therefore improper fixing generates. Therefore, the operation in the half speed mode is executed and thus a time in which the thick paper or the like passes through a secondary transfer portion or a transfer nip is prolonged, so that these problems are solved.

However, when the polarity of the applied voltage to the secondary transfer roller is switched from the opposite polarity to the polarity of the toner during the image formation to the same polarity to the polarity of the toner during the recording material feeding interval as described above, there is a problem such that back surface contamination of the recording material with the toner generates. A generation process of the back surface contamination with the toner will be described with reference to FIGS. 14 to 17.

FIG. 14 is a schematic view for illustrating the applied voltage to a secondary transfer roller 14 during the image formation. During the image formation, a toner image t formed on a surface of an intermediary transfer belt 7 is transferred from the intermediary transfer belt 7 onto a recording material S at a secondary transfer portion T2 by applying a bias of a positive polarity to the secondary transfer roller 14. Here, a charge polarity of a toner was a negative polarity.

FIG. 15 is a schematic view for illustrating the applied voltage to the secondary transfer roller 14 immediately after the image formation is ended. The polarity of the applied voltage to the secondary transfer roller 14 is switched after the recording material S sufficiently passed through the secondary transfer portion T2. For that reason, immediately after the recording material S passed through the secondary transfer portion T2, the bias of the positive polarity is still applied to the secondary transfer roller 14. At that time, of fog toners ta on the surface of the intermediary transfer belt 7, the fog toners ta at the secondary transfer portion T2 is subjected to electric discharge from the secondary transfer roller 14, so that the charge polarity is reversed and thus the fog toners ta is electrically charged to the positive polarity.

FIG. 16 is a schematic view showing a state after the intermediary transfer belt 7 and the secondary transfer roller 14 are further rotated from the state of FIG. 15. When the image formation on the recording material S is ended, control goes to control effected during a recording material feeding interval (hereinafter referred to as sheet interval control), and therefore a bias of the negative polarity is applied to the secondary transfer roller 14. At that time, when before the toner having the charge polarity inverted to the positive polarity in FIG. 13 passes through the secondary transfer portion N2, the bias of the secondary transfer roller 14 is changed from the positive polarity to the negative polarity, the toner of the photosensitive drum is attracted to the secondary transfer roller 14.

FIG. 17 is a schematic view when subsequent image formation is effected. The toner of the photosensitive drum deposited on the secondary transfer roller 14 is still deposited on the secondary transfer roller 14 by an electrostatic force during application of the bias of the negative polarity to the secondary transfer roller in sheet interval control. When the sheet interval control is ended and then the polarity of the bias of the secondary transfer roller 14 is changed to the positive polarity during the subsequent image formation, the toner ta deposited on the secondary transfer roller 14 separates from the secondary transfer roller 14. At that time, when the recording material S passes through the secondary transfer portion T2, the toner ta deposited on the secondary transfer roller 14 is deposited on the back surface of the recording material S, so that the back surface of the recording material S is contaminated with the toner ta.

The positive polarity toner deposited on the secondary transfer roller 14 can be removed when the bias of the positive polarity is applied to the secondary transfer roller 14 in a secondary transfer in which the toner is positioned at the secondary transfer portion T2 during the sheet interval control. However, when control for applying the bias of the positive polarity is effected, a sheet interval control time becomes long.

Such a problem that the toner is deposited on the secondary transfer roller 14 is liable to be conspicuous in the case where the process speed is slow (e.g., during the operation in the half speed mode). This is because in the case where the process speed is fast in FIG. 16, the toner inverted in charge polarity to the positive polarity during a change of the bias of the secondary transfer roller 14 passes through the secondary transfer portion T2 and therefore the toner is not deposited on the secondary transfer roller 14 even when the polarity of the bias of the secondary transfer roller 14 is changed to the negative polarity.

SUMMARY OF THE INVENTION

According to an aspect of the present invention, there is provided an image forming apparatus comprising: a movable image bearing member for bearing a toner image; a transfer member for forming a transfer portion for transferring the toner image from the image bearing member onto a recording material; a constant voltage source for applying, to the transfer member, a transfer voltage for transferring the toner image onto the recording material and a returning voltage, opposite in polarity to the transfer voltage, for returning the toner image from the transfer member to the image bearing member; an executing portion capable of executing continuous image formation in a continuous image forming period in which the transfer voltage is applied to the transfer member when an image region of the image bearing member where the toner image is to be transferred onto the recording material passes through the transfer portion and in which the returning voltage is applied to the transfer member at a part of a time when an inter image region of the image bearing member between an image and a subsequent image passes through the transfer portion, the executing portion being capable of selectively executing an operation in a first mode in which image formation is executed at a first speed and an operation in a second mode in which the image formation is effected at a speed slower than the first speed; and a setting portion for setting a falling time from transfer voltage falling start timing toward the returning voltage until a current flowing through the transfer member is zero, wherein the setting portion sets the falling time in the operation in the second mode so as to be longer than the falling time in the operation in the first mode.

Further features of the present invention will become apparent from the following description of exemplary embodiments with reference to the attached drawings.

DESCRIPTION OF THE EMBODIMENTS

Embodiments of the present invention will be described with reference to the drawings. The following embodiments are preferred embodiments of the present invention, but the present invention is not limited thereto. Within the scope of the present invention, various constitutions can be replaced with other known constitutions.

Embodiment 1

Image Forming Apparatus

Figure 1:
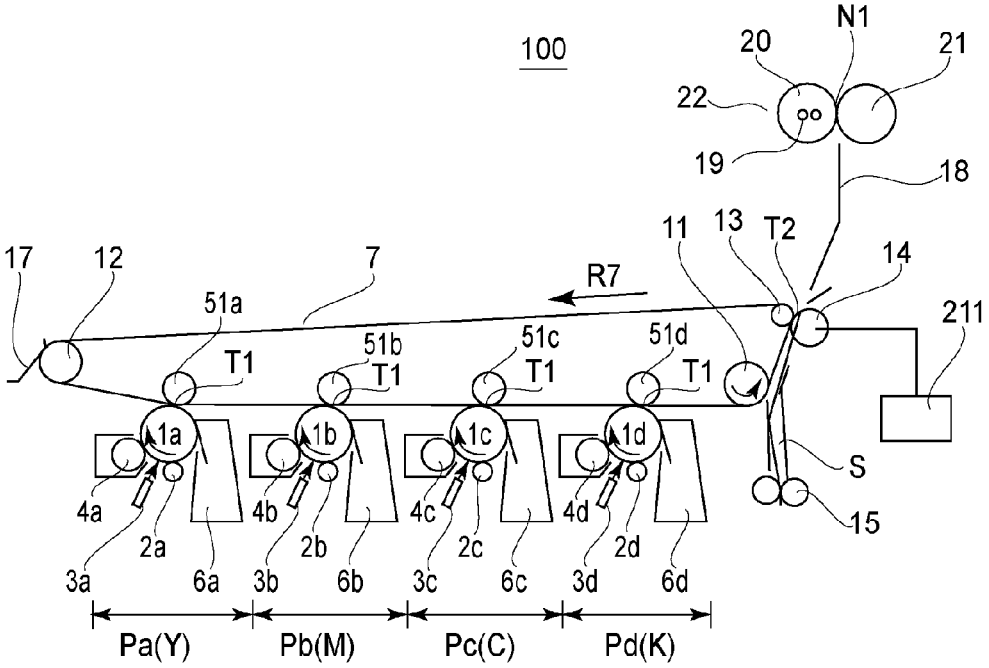
FIG. 1 is a schematic view showing a general structure of an image forming apparatus.
Figure 2:
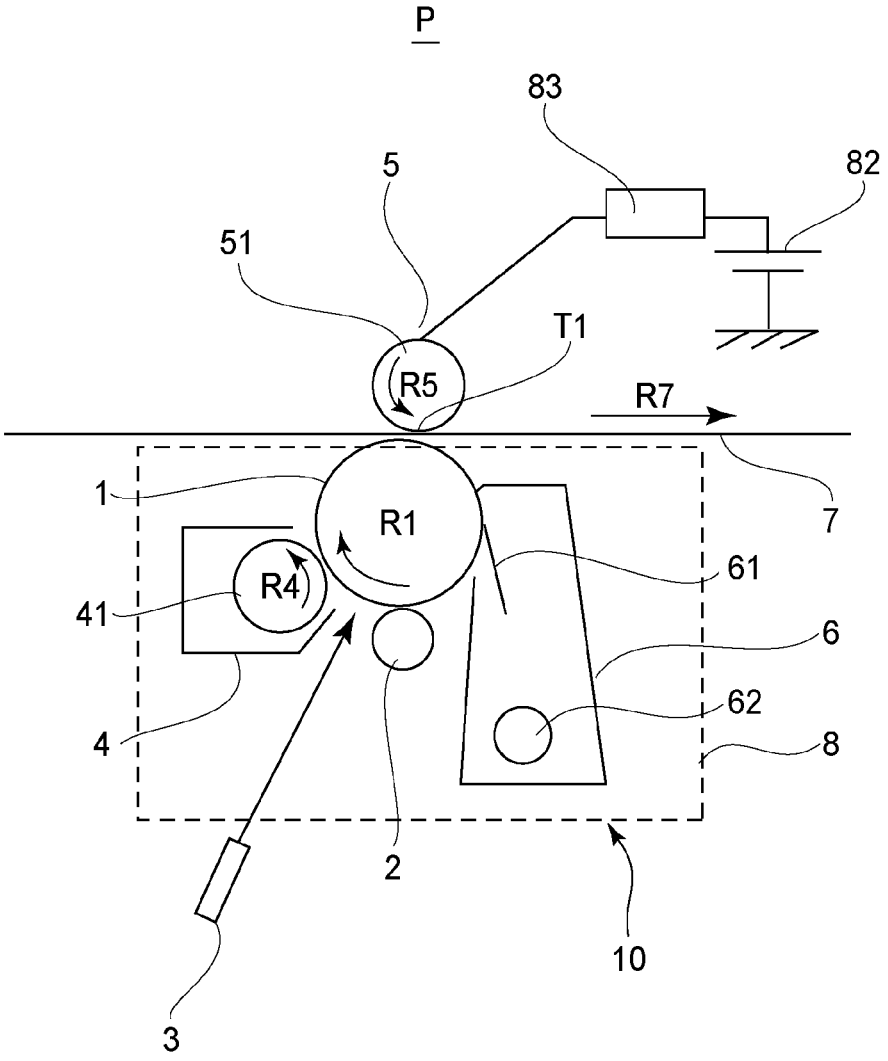
FIG. 2 is a schematic view for illustrating an image forming portion.

An image forming apparatus according to the present invention will be described with reference to FIG. 1. FIG. 1 is a sectional view showing a general structure of an example of an image forming apparatus (a full-color printer in this embodiment) using an electrophotographic recording technology. FIG. 2 is a schematic view for illustrating an image forming portion P.

The image forming portion P includes a drum-shaped electrophotographic photosensitive member (hereinafter referred to as a photosensitive drum) 1 as a first image bearing member. This photosensitive drum 1 is rotated in an arrow R1 direction at a predetermined peripheral speed (process speed) by a motor (not shown). A surface of the photosensitive drum 1 is electrically charged uniformly to a predetermined polarity and a predetermined potential by a charging voltage applied to a charging roller (charging means) (charging step).

Then, the charged surface of the photosensitive drum 1 is irradiated with laser light corresponding to an image signal by an exposure device (electrostatic latent image forming means), so that an electrostatic latent image is formed (exposure step). Then, a toner is held on the electrostatic latent image by a developing device (developing means) 4 under application of a developing voltage to a developing roller 41, so that the electrostatic latent image is developed (developing step). As a result, a toner image is formed on the surface of the photosensitive drum 1. The charge polarity of the toner used in this embodiment is negative.

The toner image formed on the surface of the photosensitive drum 1 is transferred onto a surface of an intermediary transfer belt 7 as a second image bearing member by a primary transfer device (primary transfer means) 5 (primary transfer step). The intermediary transfer belt 7 is rotatable (movable) in the same direction as the rotational direction of the photosensitive drum 1.

The primary transfer device 5 includes a primary transfer roller (contact charging member) 51 contacted to a back surface of the intermediary transfer belt 7. To the primary transfer roller 51 rotated in an arrow R5 direction by rotation of the intermediary transfer belt 7 in an arrow R7 direction, a primary transfer bias is applied from a transfer bias applying voltage source 82. As a result, the toner image formed on the surface of the photosensitive drum 1 is primary-transferred electrostatically onto the surface of the intermediary transfer belt 7 at a primary transfer portion T1. The transfer bias applying voltage source 82 is controlled by a controlling device 83.

The primary transfer bias in this embodiment is a bias consisting of a DC voltage (DC component), and is a bias of an opposite polarity to a charge polarity (normal charge polarity) of the toner.

A toner remaining on the surface of the photosensitive drum 1 without being transferred onto the intermediary transfer belt 7 during the primary transfer is removed by a cleaning blade 61 of a cleaning device (cleaning means), and is collected in a residual toner container (not shown) by a residual toner feeding screw 62.

In this embodiment, the photosensitive drum 1, the charging roller 2, the developing device 4 and the cleaning device 6 are integrally assembled in a cartridge container 8 (indicated by a broken line in FIG. 2), and constitute a cartridge (process cartridge) 10 as a whole.

The image forming apparatus 100 shown in FIG. 1 includes four image forming portions Pa, Pb, Pc, Pd each having the same structure as the above-described image forming portion P. These image forming portions Pa, Pb, Pc, Pd from toner images of colors of yellow (Y), magenta (M), cyan (C), black (K), respectively.

The image forming portions Pa, Pb, Pc, Pd include photosensitive drums 1*a*, 1*b*, 1*c*, 1*d*, charging rollers 2*a*, 2*b*, 2*c*, 2*d*, exposure devices 3*a*, 3*b*, 3*c*, 3*d*, developing devices 4*a*, 4*b*, 4*c*, 4*d*, primary transfer rollers 5*a*, 5*b*, 5*c*, 5*d* and cleaning devices 6*a*, 6*b*, 6*c*, 6*d*, respectively.

At these image forming portions Pa, Pb, Pc, Pd, the toner images of yellow, magenta, cyan, black are formed on the surfaces of the photosensitive drums 1*a*, 1*b*, 1*c*, 1*d*, respectively, similarly as in the case of the image forming portion P described above. Incidentally, in FIG. 1, members corresponding to the primary transfer voltage applying voltage source 82 shown in FIG. 2 are omitted from illustration.

The intermediary transfer belt 7 formed in an endless shape by a dielectric resin material such as polyimide is wound around a during roller 11, a follower roller 12 and a secondary transfer opposite roller 13, and is rotated in the arrow R7 direction by the driving roller 11. At the image forming portions Pa, Pb, Pc, Pd, primary transfer biases are applied to primary transfer rollers 51*a*, 51*b*, 51*c*, 51*d*, respectively. As a result, the toner images of yellow, magenta, cyan, black formed on the photosensitive drums 1*a*, 1*b*, 1*c*, 1*d*, respectively, are primary-transferred onto the surface of the intermediary transfer belt 7 at the associated primary transfer portions T1, and are thus superposed on the intermediary transfer belt 7.

In the surface side of the intermediary transfer belt 7, at a position corresponding to the secondary transfer opposite roller 13, a secondary transfer roller (transfer member) 14 is contacted to the intermediary transfer belt 7. The secondary transfer roller 14 sandwiches the intermediary transfer belt 7 between itself and the secondary transfer opposite roller 13 and forms a secondary transfer portion T2 as a transfer portion between the surface thereof and the surface of the intermediary transfer belt 7.

A recording material S subjected to image formation is accommodated in a cassette (not shown). The recording material S is fed to a registration roller pair 15 by a feeding device (not shown) including a sheet feeding roller, a conveying roller, a conveying guide and the like. After oblique movement of the recording material S is rectified by the registration roller pair 15, the recording material S is fed to the secondary transfer portion T2.

To the secondary transfer roller 14, a secondary transfer bias is applied from a first bias applying voltage source 211*a* described later when the recording material S passes through the secondary transfer portion T2. The polarity of the secondary transfer bias at this time is the positive polarity opposite to the charge polarity (negative polarity) of the toner. By this secondary transfer bias, the four color toner images on the intermediary transfer belt 7 are secondary-transferred collectively onto the recording material S (secondary transfer step).

The toner remaining on the surface of the intermediary transfer belt 7 without being transferred onto the recording material S during the secondary transfer is removed by a belt cleaner 17 provided at a position corresponding to the follower roller 12 in the (front) surface side of the intermediary transfer belt 7.

The recording material S on which the toner images are transferred is fed to a fixing device 22 along a feeding guide 18. The recording material S passes through the fixing nip N1 formed by a fixing roller 20 and a pressing roller 21. At that time, unfixed toner images on the recording material S are heated and pressed by the fixing roller 20 and the pressing roller 21 and then are fixed on the recording material S. As a result, 4-color based full-color image formation on a single sheet of the recording material S is ended.

In the image forming apparatus 100, the photosensitive drum 1*a*, the charging roller 2*a*, the developing device 4*a* and the cleaning device 6*a* are integrally assembled in a cartridge container (not shown) similarly as in the case of the cartridge 10 shown in FIG. 2, and thus constitute a cartridge for yellow. Similarly, also the photosensitive drums 1*b*, 1*c*, 1*d* the charging rollers 2*b*, 2*c*, 2*d*, the developing devices 4*b*, 4*c*, 4*d* and the cleaning devices 6*b*, 6*c*, 6*d* which are used for forming the toner images of magenta, cyan, black, respectively, constitute cartridges for magenta, cyan, black, respectively. The cartridges for the respective colors of yellow, magenta, cyan, black are detachably mountable to an image forming apparatus main assembly.

In the image forming apparatus 100, a speed (process speed) in the transfer step and the fixing step is changed depending on the species of the recording material S. In the case where as the recording material S, plain paper is subjected to printing, an operation in a constant speed mode (first mode) is executed, and in the case where as the recording material S, thick paper, coated paper, an OHT sheet or the like is subjected to the printing, an operation in a half speed mode (second mode) is executed. During the operation in the constant speed mode, the photosensitive drum is rotated at the process speed (peripheral speed) of 100 mm/sec.

<Secondary Transfer Roller 14>

The secondary transfer roller 14 is constituted by a single-layer roller of an ion-conductive foam sponge, specifically constituted by a single-layer roller of foam sponge of, e.g., a combination of ion-conductive NBR with hydrin rubber. A foam cell diameter is about 50 μm to 200 μm. The secondary transfer roller 14 is 320 mm in length with respect to a direction perpendicular to a feeding direction of the recording material S, 24 mm in outer diameter, 34 degrees in Asker-C hardness, $1\times10^8\Omega$ in resistance value and 5.0 kg in contact pressure to the intermediary transfer belt 7. However, this contact pressure is a contact pressure of the secondary transfer roller 14 in a state in which the intermediary transfer belt 7 is sandwiched between the secondary transfer roller 14 and the secondary transfer opposite roller 13 as shown in FIG. 1.

<Voltage Application Controller 210 and Speed Charge Controller 220>

Figure 3:
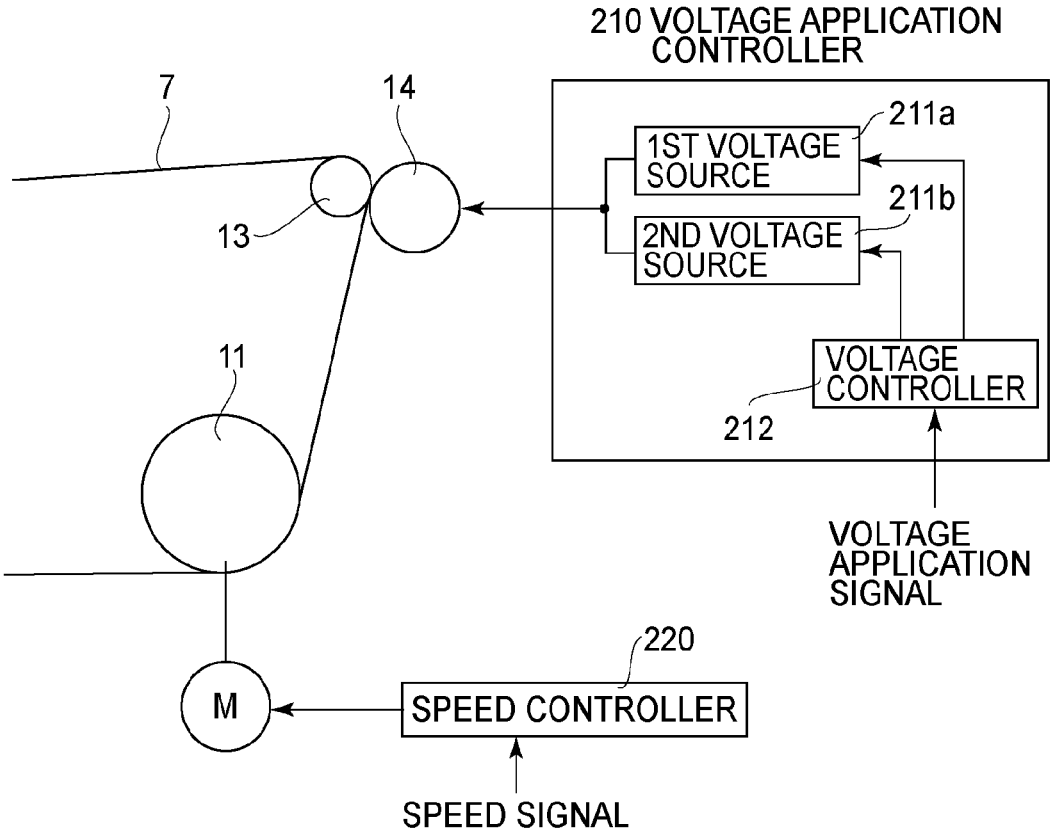
FIG. 3 is a schematic view for illustrating a voltage application controller and a speed change controller.

FIG. 3 is a schematic view for illustrating a voltage application controller 210 and a speed charge controller 220. The speed change controller (speed charge means) 220 for changing a moving speed of the intermediary transfer belt 7 is constituted so as to be capable of selectively executing the operation in the constant speed mode and the operation in the half speed mode depending on a speed instruction signal for print instruction. In the operation in the constant speed mode, a motor (driving source) M is controlled so that the intermediary transfer belt 7 is moved at a speed of 100 mm/sec (first speed). In the operation in the half speed mode, the motor M is controlled so that the intermediary transfer belt 7 is moved at a speed of 50 mm/sec (second speed) different from the above speed of 100 mm/sec.

The voltage application controller 210 includes a first voltage applying voltage source (first voltage applying means) 211*a*, a second voltage applying source (second voltage applying means) 211*b* and a voltage controller (voltage control means) 212. The first voltage applying voltage source 211*a* applies a secondary transfer voltage which is a positive bias to the secondary transfer roller 14 when the toner images are transferred from the intermediary transfer belt 7 onto the recording material S at the secondary transfer portion T2. The second voltage applying voltage source 211*b* applies a secondary transfer voltage which is a negative bias (opposite to the positive bias applied from the first voltage applying voltage source 211*a*) to the secondary transfer roller 14 during sheet interval control effected in a sheet feeding interval of the recording material S.

The voltage controller 212 executes a corresponding voltage applying sequence depending on a voltage application instruction signal for print instruction in the operation in the constant speed mode or the operation in the half speed mode, and drives either one of the first voltage applying voltage source 211*a* and the second voltage applying voltage source 211*b*. The voltage controller 212 properly controls outputs of the first voltage applying voltage source 211*a* and the second voltage applying voltage source 211*b*, and thus changes a rise time and a toner of a secondary transfer current.

<Cause of Deposition of Fog Toner on Secondary Transfer Roller 14>

In the image forming apparatus 100 in this embodiment, the deposition of the fog toner on the secondary transfer roller 14 did not generate in the operation in the constant speed mode and generated only in the operation in the half speed mode. A cause of the deposition of the fog toner on the secondary transfer roller 14 will be described with reference to FIGS. 4 and 5.

Figure 4:
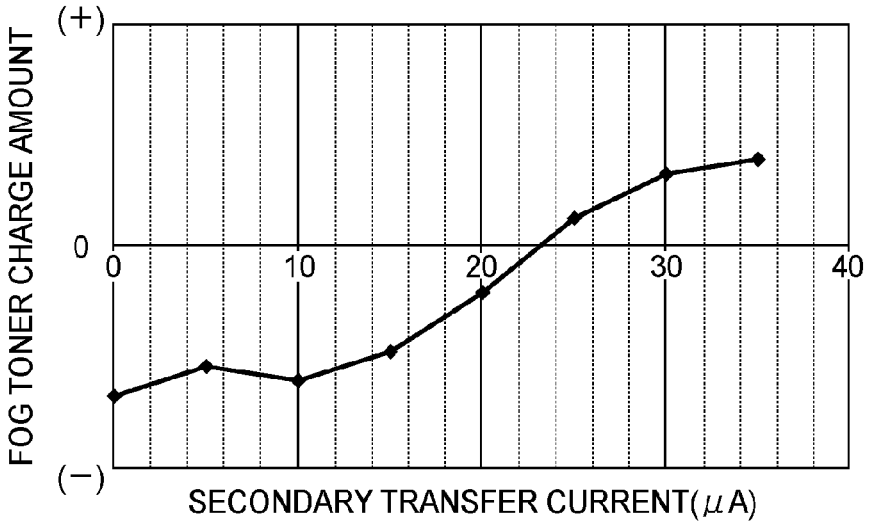
FIG. 4 is a graph showing a relationship between a charge amount of a fog toner and a secondary transfer current.

FIG. 4 shows a charge amount of the fog toner after the secondary transfer current is applied at the secondary transfer portion T2. The charge amount of the fog toner was measured by sucking the fog toner from the surface of the intermediary transfer belt 7 using a particle charge amount measuring device ("Espart Analyzer (registered trademark)", manufactured by Hosokawa Micron Corp.). As shown in FIG. 4, in the case where the secondary transfer current is not applied, the toner is negatively charged. When the secondary transfer current is increased, it is understood that the charge amount gradually increases and thus the charge polarity is inverted from the negative polarity to the positive polarity at the secondary transfer current of 23 μA.

Figure 5:
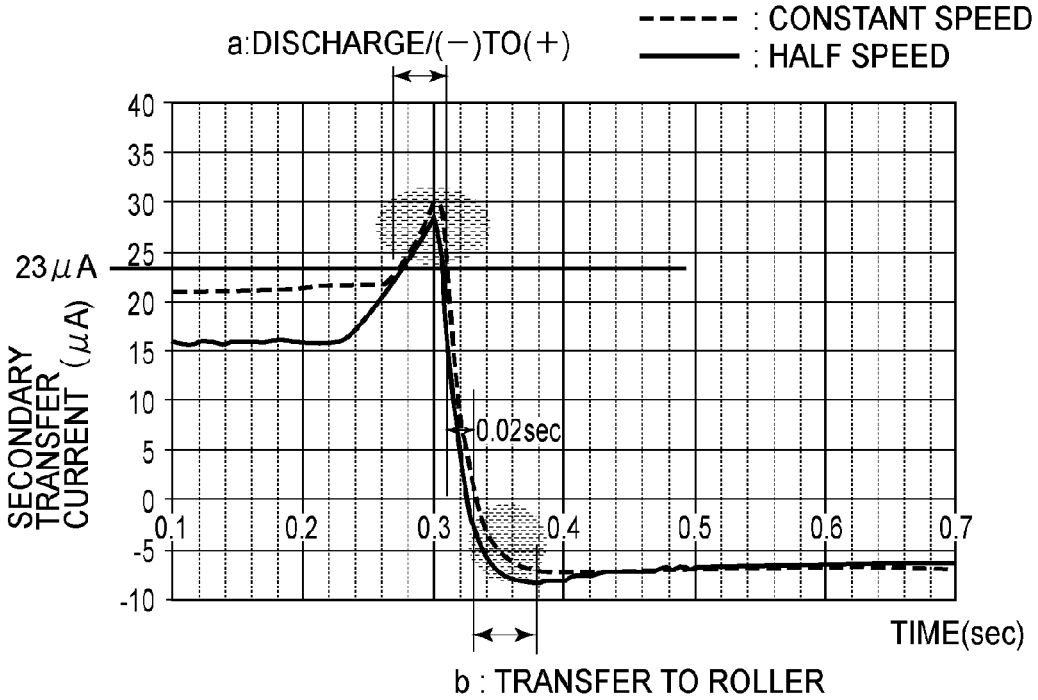
FIG. 5 is a graph showing a falling current progression of the secondary transfer current.

FIG. 5 shows a graph of a current progression during falling of the secondary transfer current. In FIG. 5, a broken line represents the secondary transfer current in the operation in the constant speed mode, and a solid line represents the secondary transfer current in the operation in the half speed mode. The secondary transfer current starts to rise at the time of 0.27 sec in the operation in the constant speed mode and at the time of 0.23 sec in the operation in the half speed mode. This is because a trailing end of the recording material S completes passing through the secondary transfer portion T2, so that a resistance at the secondary transfer portion T2 lowers.

The voltage control is effected at a constant voltage. In consideration of deviations in entrance time of the recording material S into the secondary transfer portion T2 and in passing time of the recording material S through the secondary transfer portion T2, control is effected so that the same secondary transfer voltage is applied until the recording material S sufficiently passes through the secondary transfer portion T2. For that reason, even after the recording material S passed through the secondary transfer portion T2 and thus the resistance at the secondary transfer portion T2 lowered, the same secondary transfer voltage is applied, so that the secondary transfer current increases.

Irrespective of the operation in the constant speed mode and the operation in the half speed mode, the secondary transfer current is 23 μA or above from the time of 0.28 sec to the time of 0.31 sec. Here, when a region from 0.28 sec to 0.31 sec is referred to as region a, the charge polarity of the fog T in the region a is, as shown in FIG. 4, inverted from the negative polarity to the positive polarity.

After the time of 0.31 sec, the secondary transfer current is caused to rise, so that in both of the operations in the constant speed mode and the half speed mode, the secondary transfer current is 0 μA at the time of 0.33 sec. Here, a region of the time of 0.33 sec and the later is referred to as region b.

A nip width of the secondary transfer portion T2 is 2 mm. Here, "width" refers to a dimension with respect to a direction parallel to the sheet feeding direction of the recording material S. The process speed is 100 mm/sec in the operation in the constant speed mode and is 50 mm/sec in the operation in the half speed mode. A time in which the secondary transfer current changes from 23 μA to 0 μA) between the region a and the region b is 0.02 sec (=0.33 sec−0.31 sec), in which the intermediary transfer belt 7 advances by 2 mm in the operation in the constant speed mode and 1 mm in the operation in the operation in the half speed mode. This distance of the advance of the intermediary transfer belt 7 is not less than the nip width of the secondary transfer portion T2 in the operation in the constant speed mode, but is shorter than the nip width in the operation in the half speed mode.

Therefore, in the case where the toner inverted in charge polarity from the negative polarity to the positive polarity in the region a still exists at the secondary transfer portion T2 also in the region b, only in the operation in the half speed mode, the deposition of the fog toner on the secondary transfer roller 14 generates in the region a.

<Change Control of Secondary Transfer Voltage Applied to Secondary Transfer Roller>

Figure 6:
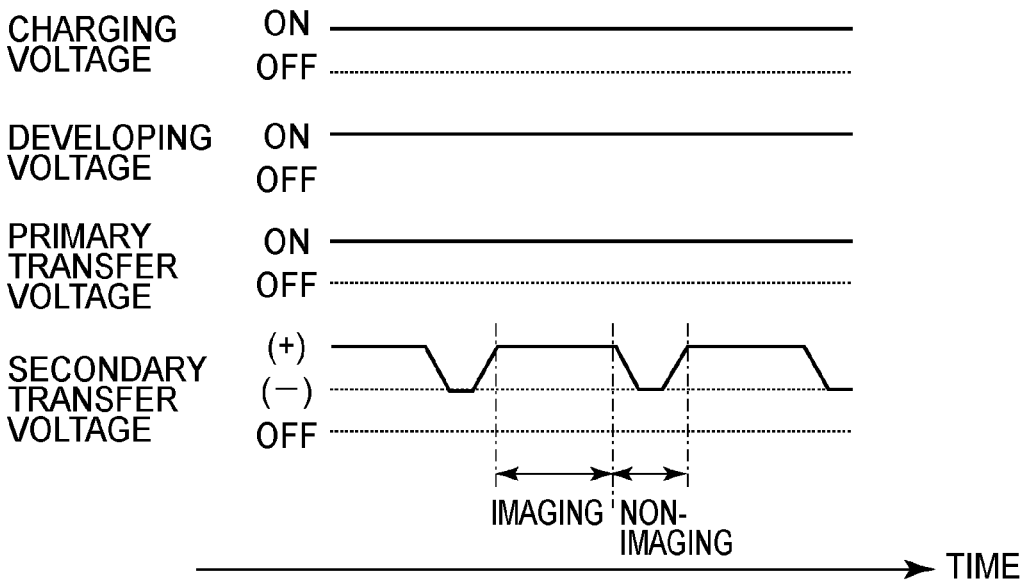
FIG. 6 is a time chart showing a voltage application sequence during continuous image formation.

Hereinafter, a feature of the image forming apparatus 100 in this embodiment will be described. A voltage applying sequence during normal image formation will be described using FIG. 6. FIG. 6 is a time chart during the operation in the constant speed mode. Specifically, FIG. 6 shows a voltage applying sequence during continuous image formation after an end of rise control in steps from the charging to the fixing.

During the continuous image formation, charging voltages, developing voltages and primary transfer voltages for colors of Y, M, C, K are not changed and certain values thereof are always applied. With respect to secondary transfer voltages, in order to transfer the toner images onto the recording material S at the secondary transfer portion T2 during the image formation, a voltage of the positive polarity is applied. During non-image formation such as during sheet interval control, in order to avoid deposition of the fog toner on the secondary transfer roller 14, a voltage of the negative polarity is applied. When the voltage is switched from the positive bias to the negative bias or from the negative bias to the positive bias, a falling time is needed. As this toner, it takes a time of about 10 msec to 150 msec.

Figure 7:
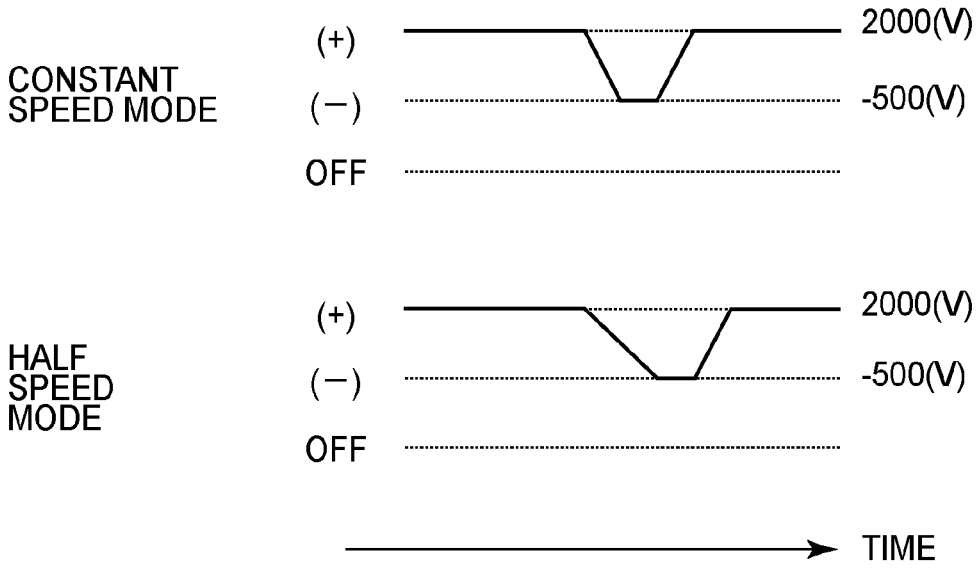
FIG. 7 is a time chart for illustrating a secondary transfer voltage in a voltage application sequence in an operation in a half speed mode in Embodiment 1.

Therefore, this embodiment has such a feature that the voltage applying sequence executed by the voltage controller 212 is changed between the operation in the constant speed mode and the operation in the half speed mode. FIG. 7 shows a secondary transfer voltage in the voltage applying sequence in the operation in the half speed mode when compared with the operation in the constant speed mode.

As shown in FIG. 7, the falling time of the secondary transfer voltage in the operation in the half speed mode is extended to twice the falling time in the case of the half speed mode. That is, a time required for switching from the applying voltage source 211*a* to the applying voltage source 211*b* is made different between the operation in the constant speed mode and the operation in the half speed mode. By controlling an output of the application voltage source 211*b* by the voltage controller 212, the time required for the switching between the operation in the constant speed mode and the operation in the half speed modeource 211*b* was changed. In both of the operations in the constant speed mode and the half speed mode, the voltage during the image formation was 2000 V, and the voltage during the non-image formation was −500 V.

Figure 8:
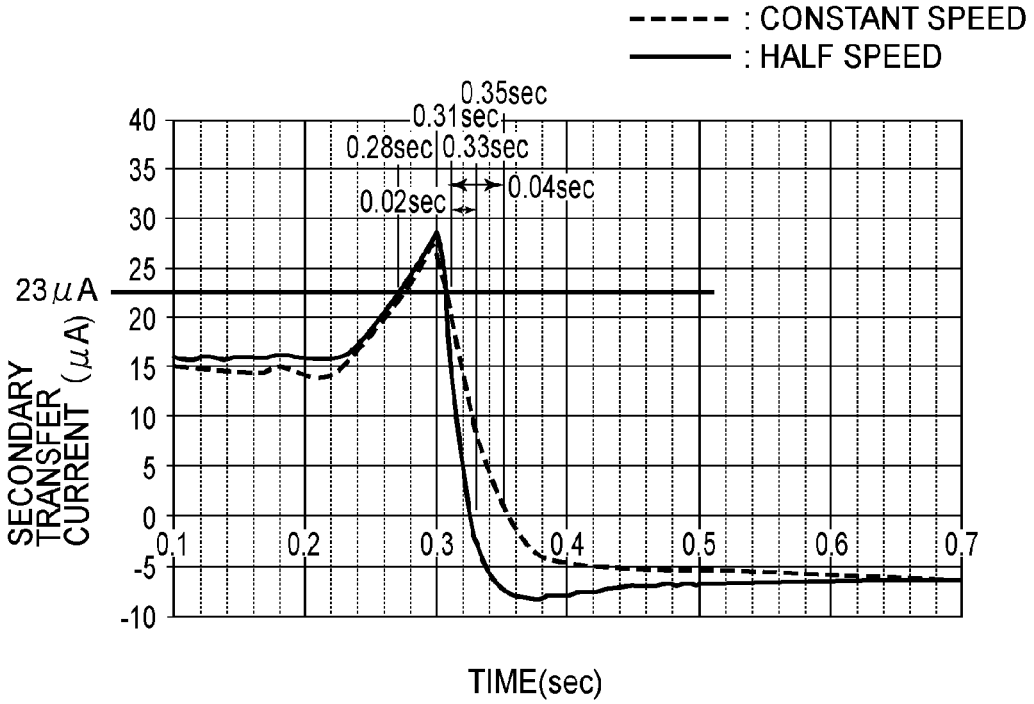
FIG. 8 is a graph for illustrating a secondary transfer current in the operation in the half speed mode in Embodiment 1.

A time progression of the secondary transfer current when the fixing is extended to the twice as described above is shown in FIG. 8. With reference to FIG. 8, the time progression of the secondary transfer current in the operations in the constant speed mode and the half speed mode will be described. A solid line shows that the falling time (response time) between 0.31 sec and 0.33 sec is once which is the same as that in the case of the constant speed mode. A broken line shows that the toner (response time) between 0.31 sec and 0.33 sec is twice the falling time in the case of the constant speed mode.

Both of the solid line and the broken line show that the secondary transfer current from 0.28 sec to 0.31 sec is 23 μA or more. The time when the secondary transfer current is 0 μA is 0.33 sec in the solid line, whereas the time is 0.35 sec in the broken line. The time in which the secondary transfer current changes from 23 μA to 0 μA is 0.02 sec (=0.33 sec−0.31 sec) in the solid line and is 0.04 sec (−0.35 sec−0.31 sec) in the broken line.

A distance in which the intermediary transfer belt 7 moves until the secondary transfer current changes from 23 μA to 0 μA is 1 mm in the solid line, and on the other hand, in the broken line, the distance is 2 mm which is the same as the distance in the operation in the constant speed mode. Accordingly, in the case where the falling time is extended to the twice, it became possible to avoid the deposition of the toner on the secondary transfer roller 14.

As described above, in the image forming apparatus 100 in this embodiment, the falling time of the secondary transfer current during the operation in the half speed mode was made twice the falling time of the secondary transfer current during the operation in the constant speed mode, so that the toner deposition on the secondary transfer roller 14 was avoided.

Originally, when the falling time is prolonged, there is a case where subsequent control cannot be effected until falling control of the secondary transfer current is sufficiently completed, and therefore is undesirable. For example, in order to obtain an image having a proper color that during the sheet interval control, in some cases, the toner image is formed on the intermediary transfer belt 7 on the basis of an image signal for detecting a density and the density of this toner image is detected by a patch image density detecting sensor (not shown), and then depending on a detection result, an image forming condition is determined. In order to prevent the toner during this density detection control from deposition on the secondary transfer roller 14, the secondary transfer current is required to be negative, so that when the falling time of the secondary transfer current is slow, a starting time of the density detection control is prolonged.

However, in the image forming apparatus 100 in this embodiment, the falling time is prolonged only when necessary, whereby it is possible to avoid not only unnecessary prolongation of a density detection control time but also the deposition of the fog toner on the secondary transfer roller 14.

A sheet interval control time in this embodiment is 0.6 sec in the operation in the constant speed mode and is 1.2 sec in the operation in the half speed mode, and a length (recording material feeding interval) of the sheet interval control is 60 mm in both of the operations in the constant speed mode and the half speed mode. This length is shorter than a length corresponding to one full circumference of the secondary transfer roller 14 ($24\times\pi=75.4$ mm). In the case where toner prolongation of the falling time of the secondary transfer current is not made, even when the sheet interval control length is longer than the length corresponding to one full circumference of the secondary transfer roller 14, the voltage of the negative polarity is continuously applied during the sheet interval control in some cases. In such cases, the toner deposited on the secondary transfer roller 14 is still deposited continuously on the secondary transfer roller 14, so that back surface contamination of the recording material S with the toner generates during subsequent image formation.

As a countermeasure thereto, when the secondary transfer of the positive polarity is applied during passing of a region of the secondary transfer roller 14, on which the toner is deposited, through the secondary transfer portion T2 during the sheet interval control, the toner is transferred onto the intermediary transfer belt 7, so that the back surface contamination of the recording material S with the toner does not generate.

Embodiment 2

Another embodiment of the image forming apparatus 100 will be described. In this embodiment, a constituent portion different from that in Embodiment 1 will be described and a constituent portion similar to that in Embodiment 1 will be omitted from description.

The image forming apparatus 100 in this embodiment prolongs the falling time by performing the falling of the secondary transfer current in the operation in the half speed mode at divided two stages in the case of a specific recording material S. That is, as a means for changing the time required for switching from the applying voltage source 211*a* to the applying voltage source 211*b* between the operations in the constant speed mode and the half speed mode, a transfer voltage smaller than the secondary transfer voltage is applied for a predetermined time by the applying voltage source 211*a* during the switching. Then, a lowering in the transfer voltage is made at least once, and the applying voltage source is switched to the applying voltage source 211*b*.

Figure 9:
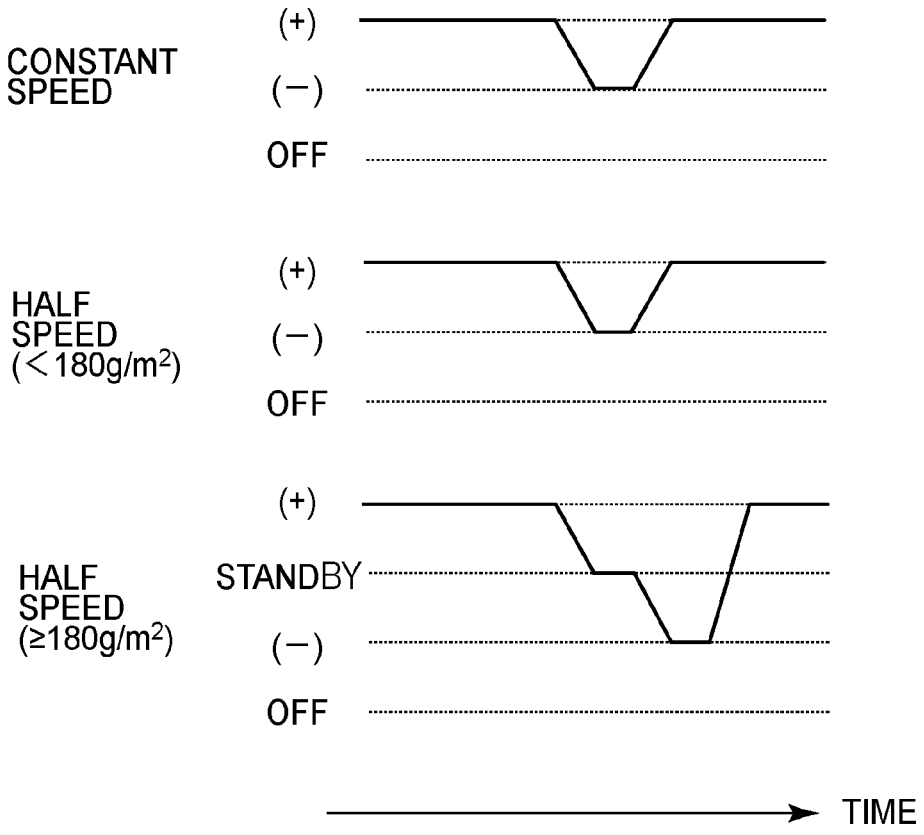
FIG. 9 is a time chart for illustrating a secondary transfer voltage in a voltage application sequence in an operation in a half speed mode in Embodiment 2.

FIG. 9 shows secondary transfer voltages in voltage applying sequences in the operations in the half speed modes when compared with the case of the constant speed mode.

On the basis of recording material information (information for representing the species of the recording material S) in printing instruction, when a basis weight of the recording material S subjected to the operation in the half speed mode is less than 180 g/m$^2$, the falling time of the secondary transfer voltage is made equal to that in the operation in the constant speed mode. When the basis weight of the recording material S subjected to the operation in the half speed mode is 180 g/m$^2$ or more, the falling time of the secondary transfer voltage is made equal to that in the operation in the constant speed mode, but during the falling, the secondary transfer voltage is once lowered to a stand-by bias and the stand-by bias is applied for a certain time, and thereafter the stand-by bias is lowered to a negative bias. The stand-by bias is a positive bias which is smaller than the secondary transfer bias during the image formation and which as such a strength that inversion of the charge polarity of the fog toner does not generate.

In this way, by waiting once at the stand-by bias, even when the charge polarity inversion of the fog toner generates, the secondary transfer bias can be made negative in polarity after waiting until the fog toner is sufficiently spaced from the secondary transfer portion T2. For that reason, it becomes possible to avoid the contamination of the secondary transfer roller 14 with the fog toner. As this stand-by voltage, in this embodiment, 100 V was applied.

When the basis weight is less than 180 g/m$^2$, the basis weight of the recording material S is small and therefore a resistance of the recording material S is low, so that the secondary transfer bias during the image formation is small. For that reason, even when the image formation is ended and the recording material S passes through the secondary transfer portion T2, the secondary transfer current does not increase to a current enough to inverse the charge polarity of the fog toner, and therefore the charge polarity inversion of the fog toner does not generate.

In this way, by discriminating the presence or absence of the stand-by bias depending on the recording material information, the falling time of the secondary transfer bias can be prolonged only when necessary, so that a printing time when recording materials of various species are continuously subjected to printing can be shortened.

Figure 10:
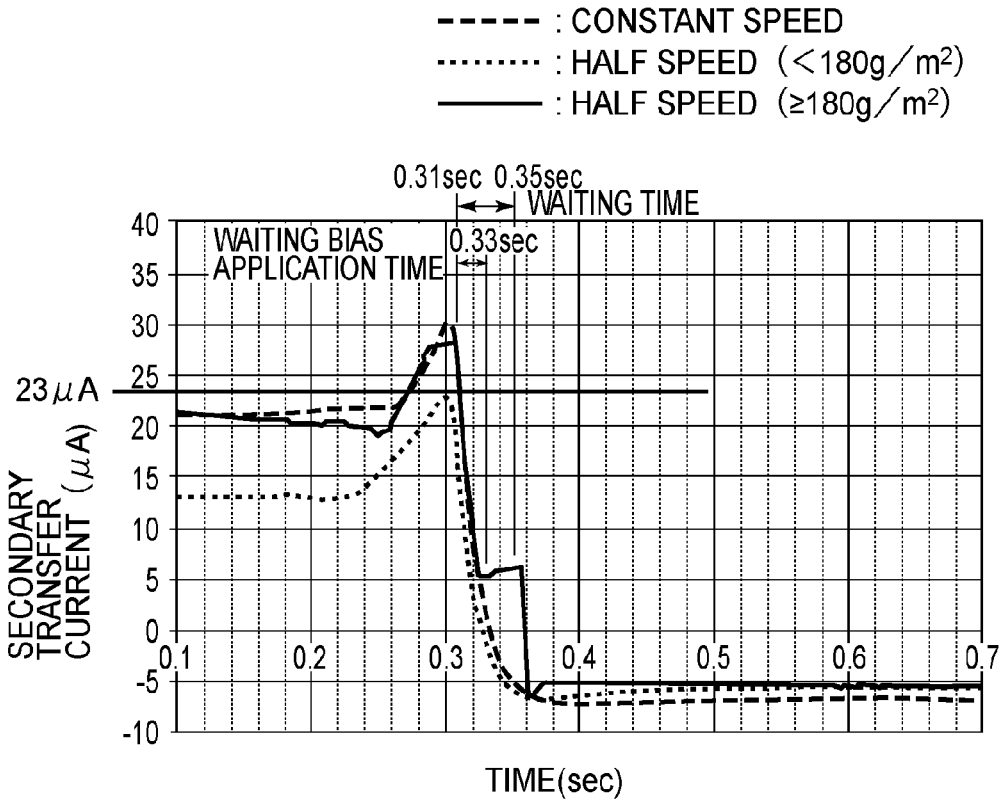
FIG. 10 is a graph for illustrating a secondary transfer current in the voltage application sequence in the operation in the half speed mode in Embodiment 2.

A time progression during falling of the secondary transfer current in the case where the above-described sequence is executed is shown in FIG. 10. A broken line shows the case of the operation in the constant speed mode, a dotted line shows the case of the operation in the half speed mode when the basis weight is less than 180 g/m$^2$, and a solid line shows the case of the operation in the half speed mode when the basis weight is 180 g/m$^2$ or more.

In the case where the basis weight is less than 180 g/m$^2$, even when the secondary transfer current increases after the recording material S passed through the secondary transfer portion T2, the secondary transfer current is not 23 μA or more. For that reason, the charge polarity of the fog toner is not inverted, and therefore even when the current is caused to fall similarly as in the operation in the constant speed mode, the deposition of the fog toner on the secondary transfer roller 14 does not generate.

In the case where the basis weight is 180 g/m$^2$ or more, the secondary transfer current increases to 23 μA or more and is 23 μA or more until 0.31 sec. During falling between 0.31 sec and 0.33 sec, the stand-by bias is applied, and at the secondary transfer current of about 5 μA, the sequence waits for passing of the toner inverted in charge polarity from the secondary transfer portion T2. In this embodiment, a waiting time therefor was 0.04 sec (=0.35 sec−0.31 sec). Thereafter, the secondary transfer current is lowered to the negative secondary transfer current. The time when the secondary transfer current is 0 μA is 0.36 sec.

A distance in which the intermediary transfer belt 7 moves until the secondary transfer current changes from 23 μA to 0 μA is 2.5 mm. The distance is not less than the nip width of the secondary transfer portion T2, and therefore it becomes possible to avoid the deposition of the fog toner on the secondary transfer roller 14.

Other Embodiments

Figure 11:
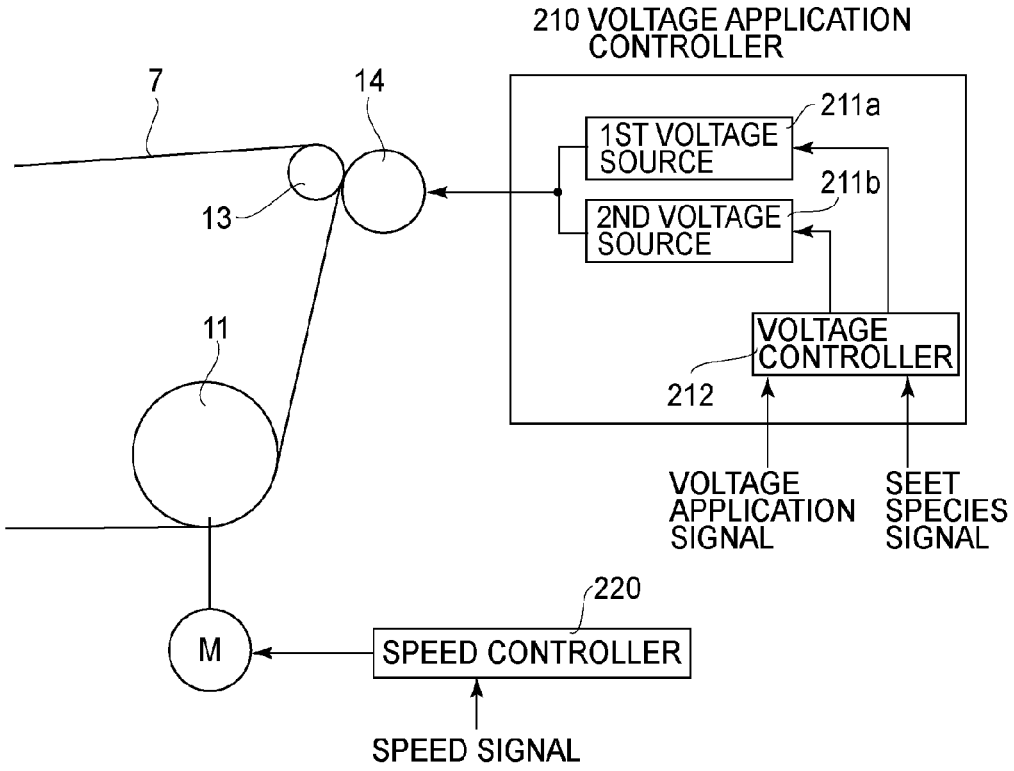
FIGS. 11 to 13 are schematic views each for illustrating another example of the voltage application controller and the speed change controller.
Figure 12:
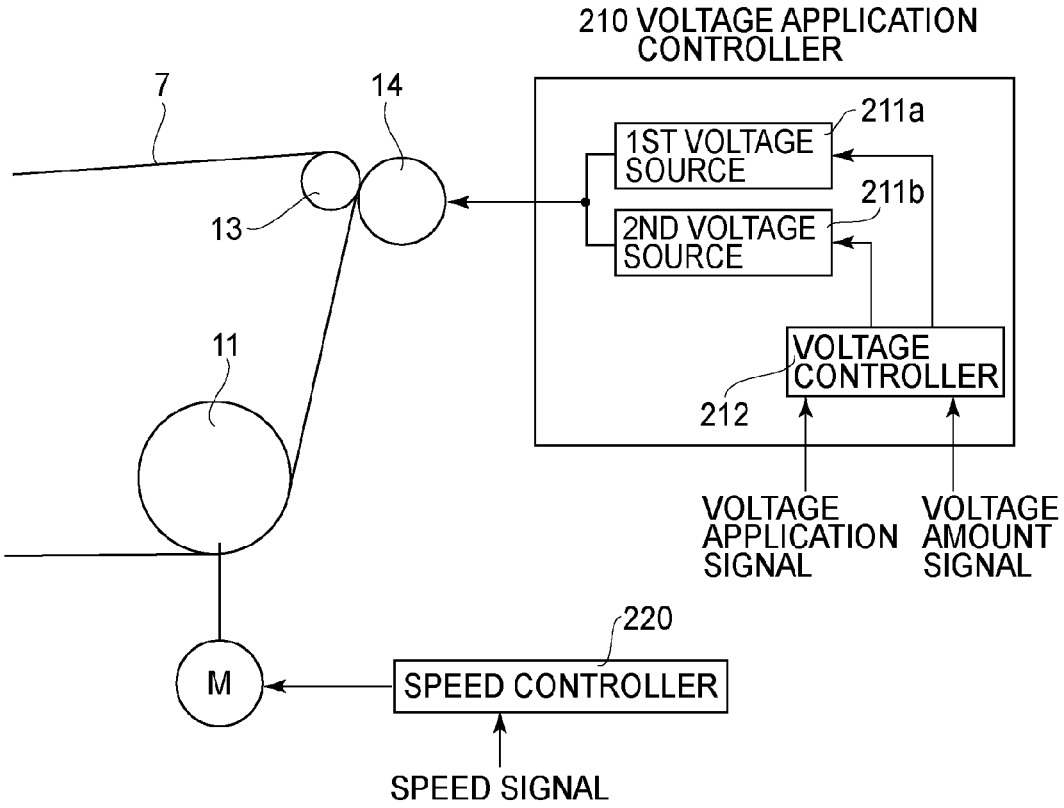
Figure 13:
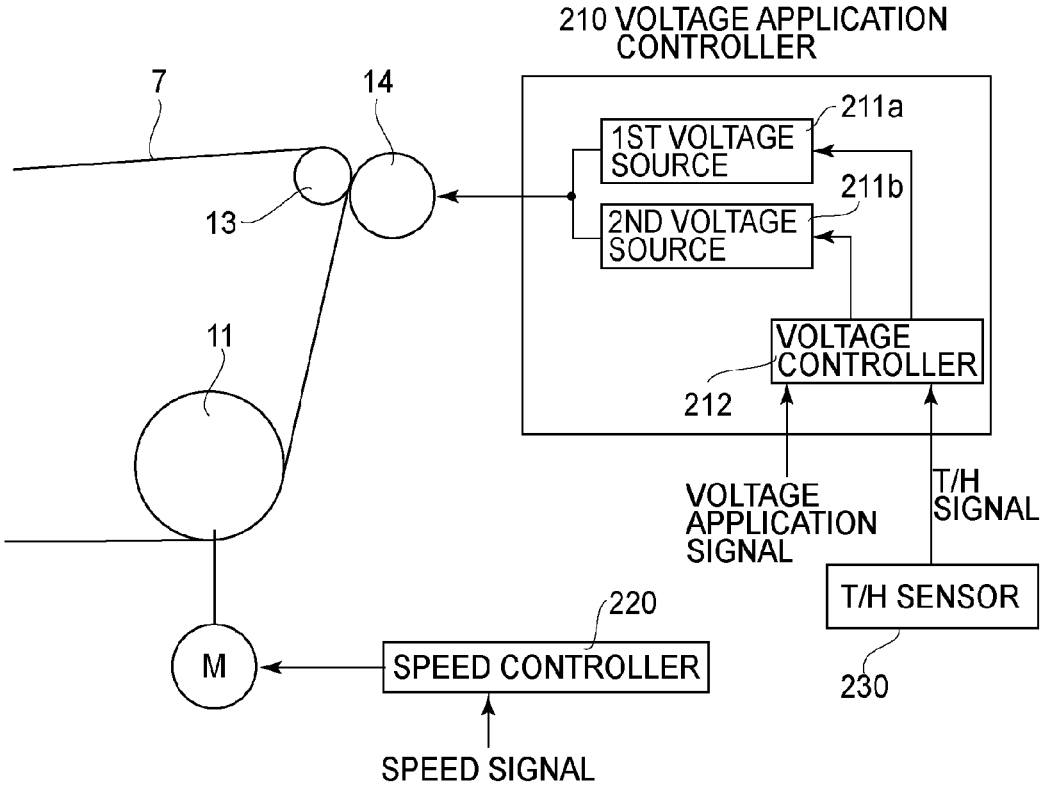
Figure 14:
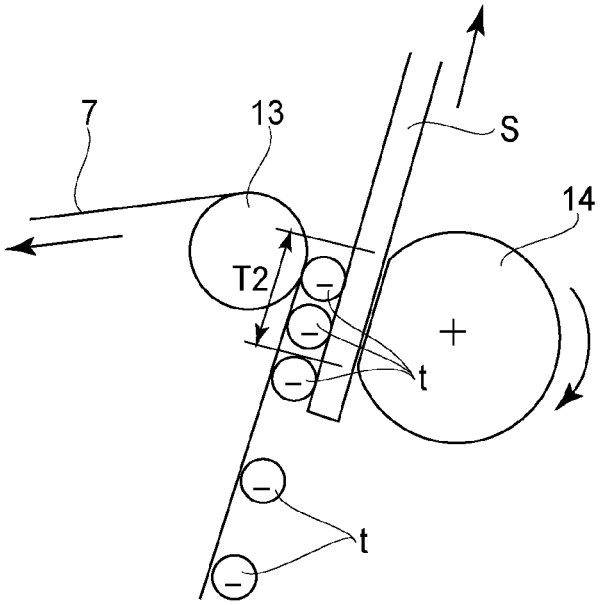
FIGS. 14 to 17 are schematic views for illustrating a generation process of a back surface contamination of a recording material.
Figure 15:
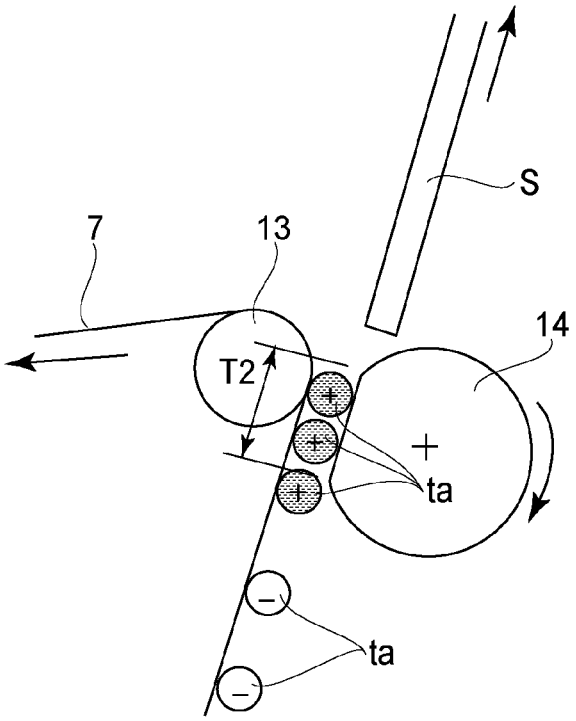
Figure 16:
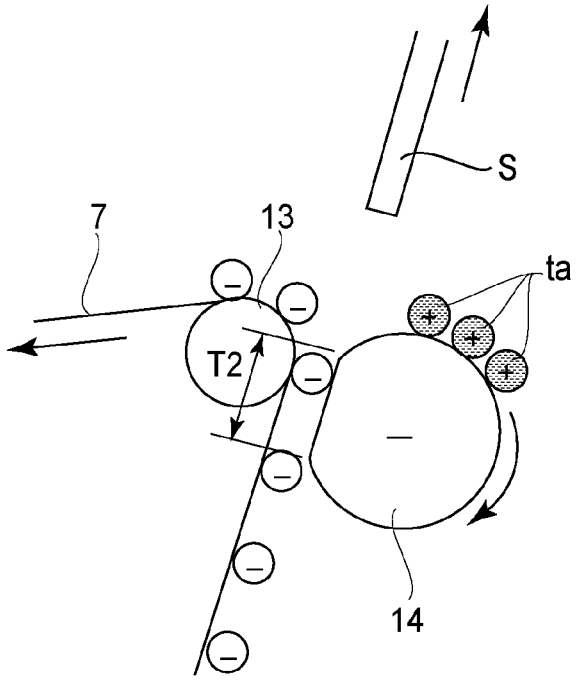
Figure 17:
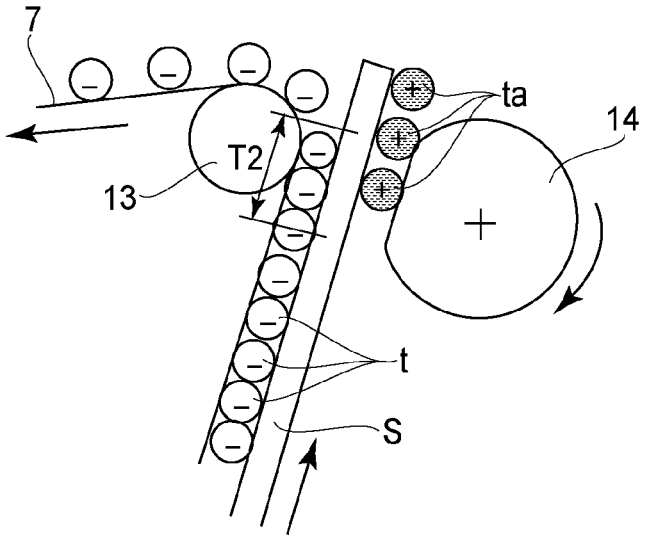

FIGS. 11 to 13 show other embodiments of the voltage application controller 210 and the speed charge controller 220.

An amount of the transfer voltage applied to the secondary transfer roller 14 varies depending on the species of the recording material S. For that reason, a predetermined voltage applying sequence depending on the species of the recording material S may also be executed by the voltage application controller 210. As shown in FIG. 11, a recording material species signal for printing instruction is received by the voltage controller 212 and on the basis of the recording material species signal, the voltage applying sequence in which the falling time is prolonged as described above is executed. In this case, a condition for changing the time required for switching the applied voltage source 211*a* to the applied voltage source 211*b* is changed depending on the species of the recording material S in addition to the discrimination whether the mode in the operation is the constant speed mode or the half speed mode.

In contrast to the above embodiment, a predetermined voltage applying sequence depending on an amount of the transfer voltage applied to the secondary transfer roller 14 may also be executed by the voltage application controller 210. As shown in FIG. 12, an applied voltage amount signal depending on a recording material species for printing instruction is received by the voltage controller 212 and on the basis of the applied voltage amount signal, the voltage applying sequence in which the falling time is prolonged as described above is executed. In this case, a condition for changing the time required for switching the applied voltage source 211*a* to the applied voltage source 211*b* is changed depending on the magnitude of the applied voltage in addition to the discrimination whether the mode in the operation is the constant speed mode or the half speed mode.

Resistances of the recording material S and the secondary transfer roller 14 vary depending on an operation environment (use environment) of the image forming apparatus 100. For example, the resistance of the recording material S becomes high in a dry environment. For temperature and humidity (environment temperature, environment humidity) measured by a temperature and humidity sensor (environment sensor), the applied voltage amount can be estimated in advance to some extent, and then depending on the operation environment, a predetermined voltage applying sequence may also be executed by the voltage application controller 210.

As shown in FIG. 12, a temperature and humidity signal from a temperature and humidity sensor 230 is received by the voltage controller 212 and on the basis of the temperature and humidity signal, the voltage applying sequence in which the falling time is prolonged as described above is executed. In this case, a condition for changing the time required for switching the applied voltage source 211*a* to the applied voltage source 211*b* is changed depending on the temperature and humidity in addition to the discrimination whether the mode in the operation is the constant speed mode or the half speed mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-002971 filed on Jan. 9, 2015, which is hereby incorporated by reference herein in its entirety.

What is claimed is:

1. An image forming apparatus comprising:

a movable image bearing member for bearing a toner image;

a transfer member for forming a transfer portion for transferring the toner image from said image bearing member onto a recording material;

a constant voltage source for applying, to said transfer member, a transfer voltage for transferring the toner image onto the recording material and a returning voltage, opposite in polarity to the transfer voltage, for returning the toner image from said transfer member to said image bearing member;

an executing portion capable of executing continuous image formation in a continuous image forming period in which the transfer voltage is applied to said transfer member when an image region of said image bearing member where the toner image is to be transferred onto the recording material passes through the transfer portion and in which the returning voltage is applied to said transfer member at a part of a time when an inter-image region of said image bearing member between an image and a subsequent image passes through the transfer portion, said executing portion being capable of selectively executing an operation in a first mode in which image formation is executed at a first speed and an operation in a second mode in which the image formation is effected at a speed slower than the first speed; and a setting portion for setting a falling time from transfer voltage falling start timing toward the returning voltage until a current flowing through said transfer member is zero, wherein said setting portion sets the falling time in the operation in the second mode so as to be longer than the falling time in the operation in the first mode.

2. An image forming apparatus according to claim 1, wherein said setting portion sets the falling time in the operation in the second mode so as to be longer than the falling time in the operation in the first mode by controlling an output of said voltage source.

3. An image forming apparatus according to claim 1, wherein said setting portion sets the falling time in the operation in the second mode so as to be longer than the falling time in the operation in the first mode by switching at least once the transfer voltage to a voltage smaller in absolute value than the transfer voltage and then by switching the voltage to the returning voltage.

4. An image forming apparatus according to claim 1, wherein said setting portion sets the falling time in the operation in the second mode so as to be longer than the falling time in the operation in the first mode depending on a discrimination result of whether the mode is the first mode or the second mode and a species of the recording material.

5. An image forming apparatus according to claim 1, wherein said setting portion sets the falling time in the operation in the second mode so as to be longer than the falling time in the operation in the first mode depending on a discrimination result of whether the mode is the first mode or the second mode and a magnitude of the voltage.

6. An image forming apparatus according to claim 1, wherein said setting portion sets the falling time in the operation in the second mode so as to be longer than the falling time in the operation in the first mode depending on a discrimination result of whether the mode is the first mode or the second mode and an environment temperature and an environment humidity at a periphery of said image forming apparatus.

* * * * *